US006851149B2

(12) United States Patent
King, Jr.

(10) Patent No.: US 6,851,149 B2
(45) Date of Patent: Feb. 8, 2005

(54) LIFT-SLIDE DRAWBRIDGE

(76) Inventor: Rex Joseph King, Jr., 111 Piping Rock Dr., Houma, LA (US) 70363

( * ) Notice: Subject to any disclaimer, the term of this patent is extended or adjusted under 35 U.S.C. 154(b) by 0 days.

(21) Appl. No.: 10/447,408

(22) Filed: May 29, 2003

(65) Prior Publication Data

US 2003/0221266 A1 Dec. 4, 2003

Related U.S. Application Data

(60) Provisional application No. 60/384,498, filed on May 30, 2002.

(51) Int. Cl.[7] ..... E01D 15/10; E01D 15/12

(52) U.S. Cl. ..... 14/43; 14/31; 14/77.1

(58) Field of Search ..... 14/73, 77.1, 31, 14/42, 43

(56) References Cited

U.S. PATENT DOCUMENTS 1,158,084 A * 10/1915 Strauss ..... 14/32
2,040,445 A * 5/1936 Taneyoshi ..... 14/42
2,482,562 A * 9/1949 Shoemaker ..... 14/42
4,296,516 A * 10/1981 Jarnum ..... 14/71.7
4,441,449 A * 4/1984 Biaggi ..... 114/263
4,473,916 A * 10/1984 Connold ..... 14/42
4,751,758 A * 6/1988 Nedelcu ..... 14/36
5,421,051 A * 6/1995 Patten ..... 14/37
5,454,127 A * 10/1995 Dvorak et al. ..... 14/19
5,495,631 A * 3/1996 Connor et al. ..... 14/2.6
5,511,268 A * 4/1996 Albus et al. ..... 14/77.1
6,568,019 B2 * 5/2003 Markelz ..... 14/43
2003/0182741 A1 * 10/2003 Prins ..... 14/71.1

* cited by examiner

*Primary Examiner*—Thomas B. Will
*Assistant Examiner*—Alexandra Pechhold

(57) ABSTRACT

This invention relates generally to a drawbridge apparatus for reversibly spanning from a first base to a second base, and more particularly to a cantilever drawbridge with an initial vertical motion of the bridge deck then a sliding or horizontal-linear motion of the said bridge deck. The invention herein described effectively overcomes the problem of the adjacent first bridge approach obstructing the sliding movement of a sliding drawbridge. This is achieved by an initial vertical motion lifting the bridge deck until it effectively clears the first adjacent bridge approach thereby allowing the sliding the bridge deck to slide over said first adjacent bridge approach. A lifting mechanism and a sliding mechanism are included in the design to provide the apparatus the means to move the bridge deck vertically and horizontally.

18 Claims, 11 Drawing Sheets

LIFT-SLIDE DRAWBRIDGE

This application claims priority of Provisional Patent Application Ser. No. 60/384,498 filed May 30, 2002.

FEDERALLY SPONSORED RESEARCH

Not Applicable

SEQUENCE LISTING OR PROGRAM

Not Applicable

BACKGROUND

1. Field of Invention

This invention relates generally to a drawbridge apparatus and more particularly to a drawbridge with an initial vertical motion followed by a sliding or horizontal-linear motion.

2. Description of Prior Art

Drawbridge designs based on vertical lift, vertical rotation and horizontal rotational movement have often been utilized as drawbridges for pedestrian, vehicular, and railroad traffic. There are various vertical lift bridge designs in the prior art, which use vertical movement as their only means of creating the reversible draw. Several types of drawbridge designs are in the prior art based on the cantilever including a bascule (only vertical rotation), a swing (only horizontal rotation) as their only means of creating the reversible draw. Sliding (only horizontal-linear movement) bridges for creating the reversible draw are in the prior art but have not come into use.

Of these four mentioned drawbridge types, each is based on a single direction of movement to create the draw. Only the vertical lift, bascule and swing bridges have come into practical use. Although drawbridges based on the sliding deck movement have many advantages, the use of the sliding bridge movement has not come into use due to the unobvious solution to the problem of the adjacent bridge approaches obstructing the sliding movement of the bridge. Whereas the vertical lift, bascule and swing bridges have an obvious simple connection between the bridge and the adjacent approaches that does not interfere with the movement of the bridge deck.

Vertical Lift Bridge in Prior Art

The draw or open position for the vertical lift bridge is created when the deck of the structure is moved vertically to a sufficient height to allow for marine (or other) traffic. The draw is the opening created when the bridge deck is removed. The clear-height is the height to which traffic can safely pass under the open vertical lift bridge. The required clear-height is usually determined from the records of past use of the channel. Therefore, the vertical clearance of all vertical lift bridges is finite and after the structure is built only traffic whose overall height is lower than the vertical lift bridges constructed clear-height will be able to traverse the channel. But since the actual clear-height will vary with the elevation of the water in the channel, marine vessels must always be aware of the changing water elevations since at times a particular vessel may not be able to safely pass under the vertical lift bridge's draw.

In addition, if the proposed vertical lift bridge structure must accommodate several lanes of traffic the wide deck and resultant heavy loads require the vertical lift bridge's superstructure to become quite massive. Also as the required clear-height of the channel increases the height of the vertical lift bridge superstructure increases. This height (perhaps fifty (50) or more feet above the adjacent ground elevation) of the vertical lift bridge superstructure poses risk to life and limb during construction as well as during future vertical lift bridge maintenance. As a result vertical lift spans can and have become quite expensive to design, construct and maintain.

The following patents by L. H. Shoemaker (U.S. Pat. No. 2,482,562) and T. Sakamoto (U.S. Pat. No. 2,040,445) are examples of vertical lift bridges in the prior art.

Bascular Bridge in Prior Art

For the bascular type cantilever bridge, the bridge deck is moved to create the draw by rotating the structure vertically (usually 70 to 80 degrees from horizontal) to open sufficiently for boats to pass and then to close again. For the bascular bridge a counterbalanced weight is necessary to facilitate the lifting of the heavy deck structure. For the bascular bridge, a major design weakness is the need to design the clear-span much wider than the clear-span required by marine (or other) traffic. The clear-span is the transverse clearance required by marine (or other) traffic to safely traverse an open drawbridge. The additional clear-span width is required in the design to safely offset the bascular bridge deck to prevent any marine collisions with said bascular bridge deck.

In the case of a twin-cantilevered bascule bridge the two sides of the bridge project inwardly and are essentially two simple cantilevered beams. Heavy loads at the point where the twin-cantilevers touch at the center of the bridge must be accounted for in the design resulting in heavy bascule cantilever structural members.

Therefore the typical bascular bridge's cantilever length is normally much longer than necessary for the required clear-span of marine (or other) traffic and the heavy-duty construction required to support the simple twin-cantilevered beams and corresponding added weight to the entire structure makes the bascular bridge structure a very cumbersome device to move quickly. Thus vehicular traffic is typically tied up waiting long periods for the bridge to open sufficiently for boats to pass and then to slowly close again. Also when overcoming the above cited design weaknesses by designing the typical bascular bridge larger than would otherwise be needed by vehicular traffic, the financial expense and time required to construct the bridge structure increases substantially.

In addition, when the proposed bridge structure must accommodate several lanes of traffic the resulting added width of the bascular bridge can become difficult and expensive to design and construct making their design and construction impractical for many proposed bridge locations. Also it is common for the bascular bridge to be closed to vehicular traffic for several days while in maintenance.

The patent to Patten (U.S. Pat. No. 5,421,051) discusses attempts at solving some of the bascule bridge design problems.

The following patents by Lucian I. Nedelcu (U.S. Pat. No. 4,751,758) and Ivan Dvorak, Shankar Nair and Vinod C. Patel (U.S. Pat. No. 5,454,127) are examples of bascular bridges in the prior art.

Swing Bridge in Prior Art

For the swing type cantilever bridge the draw is created by rotating the bridge deck horizontally approximately 90 degrees to open sufficiently for marine (or other) traffic to pass and then to reverse the direction of the rotation to close the draw. The typical swing bridge superstructure is supported at its center on a turntable creating a two-armed cantilever bridge deck balanced on said turntable.

The swing bridge's cantilever swing span is typically offset to allow for the required clear-width of marine traffic and to safely place the swing bridge's structure where minimal damage to the bridge would occur in the case of collisions. Also the wider the swing bridge becomes (due to additional lanes of traffic) a proportional increasing of the offset is required. As a result the swing span bridge cantilevers are typically much longer than required to maintain marine traffic.

If the swing span bridge is to acceptably perform without a "see-saw" effect on the traveling public the long cantilevers must be designed with heavy members. This also adds significant weight to the typical swing drawbridge requiring the bridge to have a much heavier construction than is otherwise needed to support design loads. Therefore, the typical horizontal swing bridge's cantilever length is normally much longer than is required to effectively create a clear-span for marine (or other) traffic. The heavy-duty construction required for the bridge to provide an acceptable "ride" performance for the traveling public and corresponding added weight to the entire structure makes the swing bridge a very cumbersome device to move quickly. Thus traffic is typically tied up waiting long periods for the bridge to open sufficiently for boats to pass and then to slowly close again.

In addition, if the proposed bridge structure must accommodate several lanes of traffic, the clear-space requirements for the bridges swing motion along with the above cited horizontal swing bridge disadvantages can make it difficult and expensive to design and construct. Also in many cases the swing type cantilever bridge turntable is placed in the channel, making inspection and maintenance of the main support structure difficult and expensive. Also it is common for the swing bridge to be closed to vehicular traffic for several days while in maintenance.

The patent to J. B. Strauss (U.S. Pat. No. 1,158,084) is an example of a horizontal swing span in the prior art.

Slide Bridge in Prior Art

For the slide type cantilever bridge the draw is created by sliding the bridge deck horizontally to allow for boats (or other) traffic to pass. The slide direction is then reversed to close the draw. The typical slide type cantilever bridge superstructure is supported at one end creating a cantilever bridge deck.

The sliding cantilever bridge design, although in prior art, has not come into common use likely due to the cumbersome and impractical solutions to the problem of the adjacent bridge approaches obstructing the sliding motion of the said cantilever bridge. One solution was to have a low approach to the bridge with a ramp attached to the bridge deck that would slide with the said bridge deck. The ramp solution is not practical for modern high speed traffic since the ramp may need to be several hundred feet long. Another solution was to have a removable deck which would be removed by some means prior to the sliding of the bridge deck. The removable deck solution is also not practical because it is in essence a second drawbridge that has to be constructed adjacent to a sliding drawbridge.

The patents to W. E. Aston (U.S. Pat. No. 567,875) and T. R. Bevans (U.S. Pat. No. 663,484) are examples of slide type cantilever bridges in the prior art.

Summary of Prior Art

In consideration of the limitations of the drawbridge structures as disclosed in the prior art and as discussed and cited above, it should be apparent that an effective solution to the problem of quickly and efficiently reversibly spanning a distance without having to build the drawbridge structure to accommodate above cited weaknesses is needed. Accordingly, the present invention of a lift-slide drawbridge provides significant advantages over previous drawbridge structures used to reversibly span over waterways or other obstacles.

OBJECTS AND SUMMARY OF THE INVENTION

The invention herein described effectively overcomes the problem of the adjacent bridge approaches obstructing the sliding movement of a sliding drawbridge. In addition, the invention described herein solves many of the design weaknesses of current drawbridge designs as described below.

After reviewing the requirements of the traveling public, the following is a summary of the advantages of the lift-slide drawbridge. The lift-slide drawbridge:

(a) is a continuous fixed span providing a smooth consistent high speed ride for the user;

(b) can be opened and closed quickly;

(c) is simple to operate;

(d) is low to the ground and accessible so that it can be safely and easily inspected;

(e) is easy, inexpensive and safe to maintain;

(f) can be maintained while in service;

(g) can be constructed with minimal disruption to marine traffic;

(h) can be constructed safely and quickly;

(i) has infinite height clearance for marine traffic;

(j) is scalable in width so that it can be designed to accommodate from one to many lanes of traffic;

(k) is scalable in length so that it can be designed to cross small or large distances;

(l) is scalable in duty so that it can be designed to accommodate light or heavy duty traffic;

(m) is scaleable in width, length and duty which makes it possible for a drawbridge to be sized to meet the needs of a location with a resultant substantial cost savings; and (n) is an attractive design and should be welcome in any neighborhood.

The present invention is a drawbridge structure which overcomes many of the drawbacks inherent in conventional drawbridges, as discussed above, by providing a combination of (1) a bridge deck supported by base (pier) structures when in the closed (lowered) position, open to traffic on the bridge (2) a lifting mechanism to effectively raise said bridge deck as required to clear the lift-slide drawbridge's approaches and/or other obstacles, (3) a sliding mechanism to effectively slide horizontally the raised bridge deck creating the required draw. The draw is the opening created when the bridge deck is removed.

Specifically, in accordance with a preferred embodiment of this invention, a drawbridge apparatus for reversibly spanning from a first approach to a second approach is provided. The preferred embodiment of the apparatus includes a first base (foundation), a second base (foundation), a bridge deck, a means of lifting, counterweight means and a means of sliding. When in the closed (lowered) position the bridge deck is supported by the first base and the second base, and functions as a continuous fixed span. In the open (raised) position the bridge deck is coupled to the means of sliding mechanism connected to the top of the means of lifting. The lifting mechanism provides the support structure and the means of lifting the bridge deck. The sliding mechanism provides the means of sliding the bridge deck horizontally. The bridge deck slides toward the second approach to close the draw and away from said second approach and over the first approach to open the draw.

In accordance with the preferred aspect of this invention, the means of lifting mechanism is a scissors type lift mechanism which is secured to the first base by means of a support platform on its lower end. The lifting platform is the top part of the lifting mechanism. The means of sliding is sandwiched between the lifting mechanism and the bridge deck. The bridge deck is above the means of sliding and the lifting mechanism is below said means of sliding. The means of lifting mechanism raises and lowers the bridge deck from the lowered-closed position to the raised-closed position generally in a vertical linear motion relative to the first base. The required distance the bridge deck is raised is approximately the overall thickness of the bridge deck plus one foot (estimated to vary from 4 to 8 feet depending on the size of the bridge). In the preferred embodiment of the invention, the lift mechanism is raised when hydraulic cylinders which are disposed along a lifting beam are activated causing the said lifting beam to move horizontally. The hydraulic cylinders are activated by a means of drive. The means of drive could be any appropriate hydraulic pump system.

The lifting bars are connected to the lifting beam on one end and to the lower end of selected scissors lift arms at specific points along the said lifting bar. The horizontal movement of the lifting beam moves the lifting bars horizontally. The horizontal movement of the lifting bar causes the scissors lift arms linkage to pivot about its axis effectively raising or lowering the lifting platform, sliding mechanism and the bridge deck depending on the direction of activating force applied.

The means of lifting may comprise any means of lifting capable of creating the needed vertical movement of the bridge deck, such as those preceded in utility patents by Michael Schirmer (U.S. Pat. No. 6,257,372 B1), Richard T. Rowan (U.S. Pat. No. 5,722,513) or Haakon G. Egeland (U.S. Pat. No. 3,628,771).

In accordance with another preferred aspect of this invention, the means of sliding mechanism is secured to the means of lifting mechanism and is coupled with the bridge deck. The means of sliding allows the bridge deck (when the bridge deck is in the raised position) to move generally in a linear-horizontal (sliding) motion relative to the first and second bases.

Preferably the means sliding includes deck guides, flanged wheel trucks, deck rack, a deck drive motor, and a deck pinion gear. The deck rack is secured to the underside of the bridge deck. The deck drive motor is secured to the means of lifting mechanism. The deck drive motor is activated by a means of drive. The means of drive could be any appropriate hydraulic pump system. The deck pinion gear is coupled to the drive motor and operatively engaged with the deck rack. To hold the bridge deck in position during sliding movement, deck guides and flanged wheel trucks are disposed between the said bridge deck and the means of lifting mechanism.

The means of sliding may comprise of any mechanism capable of creating the needed sliding (or straight line motion) of the bridge deck relative to the first and second bases such as the one preceded in the patent by Kunio Mori and Yoshio Shirage (U.S. Pat. No. 3,668,729).

In accordance with another preferred embodiment of this invention, a counterweight system is provided to assist in the vertical movement of the bridge deck. Also to minimize the height of the counterweight system, lifting posts are utilized. The lifting posts are vertical structural beans designed to allow transfer of load between the lifting mechanism and the counterweight at a determined elevation below the said lifting mechanism. The counterweights are attached to the lifting mechanism at the lower end of the lifting posts by means of lifting cables threaded over a suitable pulley. The upper ends of the lifting posts are attached to the lifting mechanism. The lifting posts may also protrude downward through lifting post openings in the first base to provide for additional overall lower counterweight elevation.

The counterweight system may comprise any means of counterweight capable of being configured to provide the counterweight requirements of a particular bridges design parameters.

In accordance with alternate embodiment of this invention, a deck counterweight is provided to assistance in the stability of the bridge deck. The bridge deck stability is adjusted by changing the center of gravity of said bridge deck. The bridge deck stability is also adjusted by changing the density or mass of the material used in the bridge deck construction or by attaching an additional weight mass to the bridge deck at the required location.

The deck counterweight system may comprise any means of deck counterweight capable of being configured to provide the deck counterweight requirements of a particular bridge decks design parameters.

In accordance with another alternate embodiment of this invention, a deck support bars are provided for support of the bridge deck at all sliding positions. The deck support bars are placed parallel to the sliding movement of the bridge deck adjacent to the first approach. A deck support wheel trucks are connected to the underside of the bridge deck to correspond to and engage the deck support bars.

The deck support system may comprise any means of deck support capable of being configured to provide the deck support requirements of a particular bridge decks design parameters.

Another novel feature of the lift-slide bridge is to offset the sidewalk and/or handrail in the area adjacent to the first base and first approach. Offsetting the sidewalk and/or handrail effectively places them out of the way of the sliding movement of the bridge deck. Therefore, with an offset sidewalk and/or handrail, the bridge deck only needs to be raised higher than the first approach. Also by offsetting the sidewalk and/or handrail adjacent to the first approach, space is provided for the means of deck support to be placed adjacent to said first approach between said first approach and the offset sidewalk and/or handrail.

In accordance with another alternate embodiment of this invention, when sidewalks and/or handrails are provided, said sidewalks and/or handrails are offset in the area adjacent to the first base and the first approach. By placing the sidewalks and/or handrails adjacent to the lifted deck, the overall vertical distance the bridge deck needs to be raised is minimized.

In accordance with an alternate aspect of this invention, the bridge deck has a curved shape in the vertical and/or horizontal directions. Depending on the site specific conditions and/or design requirements at a proposed bridge location, a bridge deck may need to vary in shape. The vertical curve and/or the horizontal curve may be required to fit the local roadway alignment. A proposed bridge location may require turning lanes requiring the bridge deck to become asymmetrical.

In accordance with another alternate embodiment of this invention, a method of constructing a fixed-span bridge is provided. The method includes sliding a bridge deck horizontally over an obstacle to be bridged then vertically lowering the structure into its fixed position. A means for sliding and a means for lifting would be installed to facilitate the fixed-span installation. After the installation, all or part of the means for sliding and means for lifting could then be removed from the bridge structure.

In accordance with another alternate embodiment of this invention, twin opposing lift-slide drawbridges are positioned on opposite sides of a draw. By means of sliding the extended ends of the first and second bridge decks are interlocked then simultaneously lowered onto their bases effectively creating a twin lift-slide drawbridge. The interlock of the extended ends of the bridge decks is accomplished by means of a sleeve installed on the first bridge deck's extended end and a shaft installed on the second bridge deck's opposing extended end. Any means could be used which effectively locks the extended ends of the bridge decks together.

Also the locking of the base ends of the first and second cantilevered bridge decks is accomplished by means of a shaft installed vertically on the base ends of said first and second cantilevered bridge decks. To receive the shaft, an interlocking sleeve is installed on the first and second bases and sized and positioned to receive the said shaft. Any means could be used which effectively locks the base ends of the bridge decks down. For the deck locking systems to function properly, the raising or lifting movement of the first and second cantilevered bridge decks will need to function simultaneously.

SUMMARY

In accordance with the present lift-slide drawbridge invention, a method of moving a bridge deck comprising the following steps: (a) providing a means of supporting said bridge deck; (b) providing a means vertically moving said bridge deck to allow unobstructed lateral movement of said bridge deck; (c) providing a means of sliding or horizontally moving said bridge deck lateral to its initial position to effectively create a draw.

The apparatus comprises a first and second base, bridge deck, means of lifting mechanism, means sliding mechanism and means of counterweight. The bridge deck structure is slidably coupled to the means of lifting mechanism by means of a sliding mechanism. The lifting mechanism is positioned on top of and is supported by the first base. The counterweight system facilitates the vertical movement of the bridge deck and lifting mechanism. The lifting mechanism makes possible the raising and lowering (vertical movement) of the bridge deck relative to the first base. The sliding mechanism makes possible the horizontal movement of the bridge deck relative to the first and second bases to create a draw.

DRAWINGS

Drawing Figures

PREFERRED EMBODIMENTS OF THE INVENTION

The operation of the lift-slide drawbridge consists of a two step bridge movement; the bridge deck 40 is first moved vertically then moved horizontally. To close the lift-slide drawbridge the process is reversed.

Description—FIGS. 1–8—Preferred Embodiment

Figure 2:
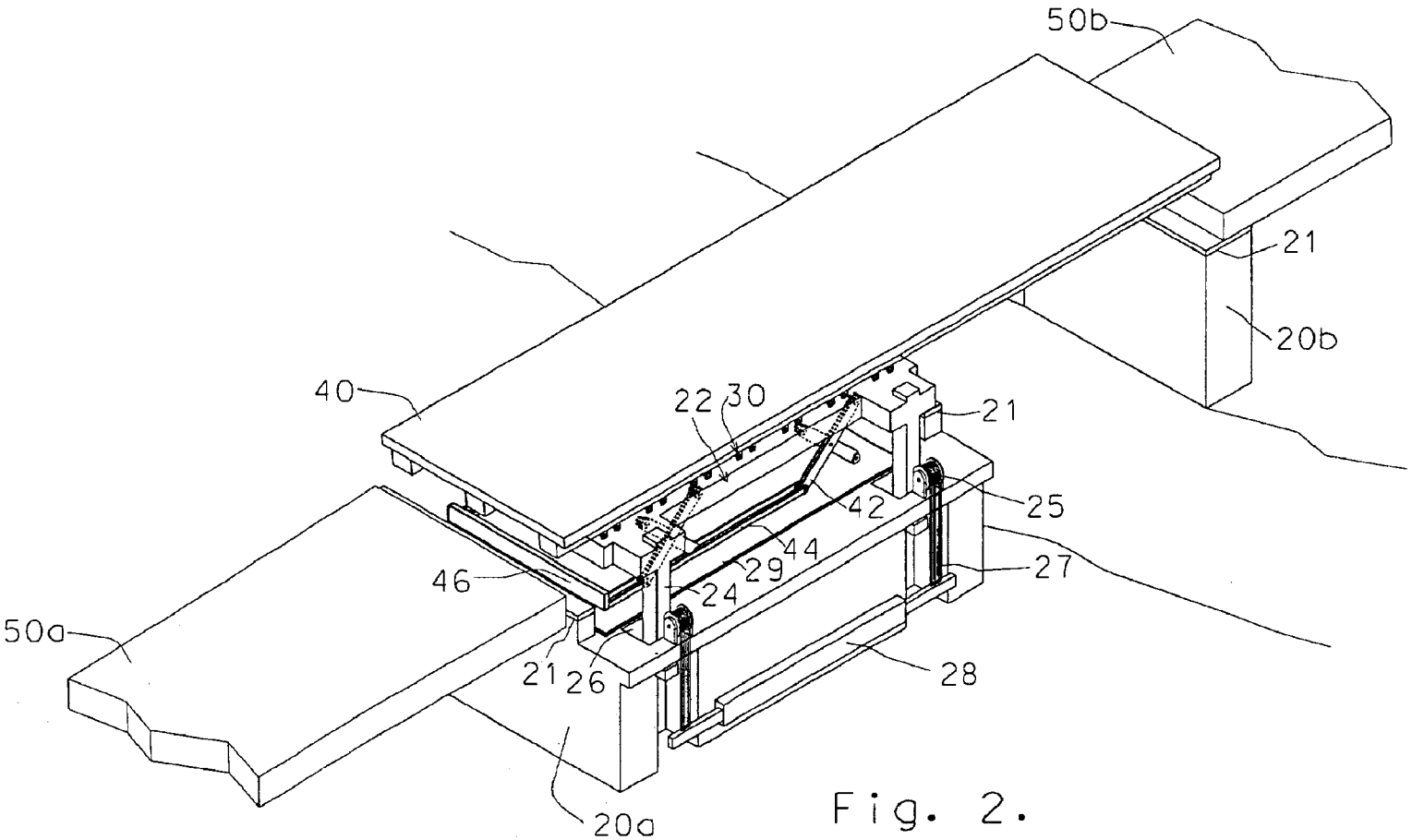
FIG. 2 illustrates a perspective view of a preferred embodiment of the invention showing the bridge in the raised-closed position.
Figure 3:
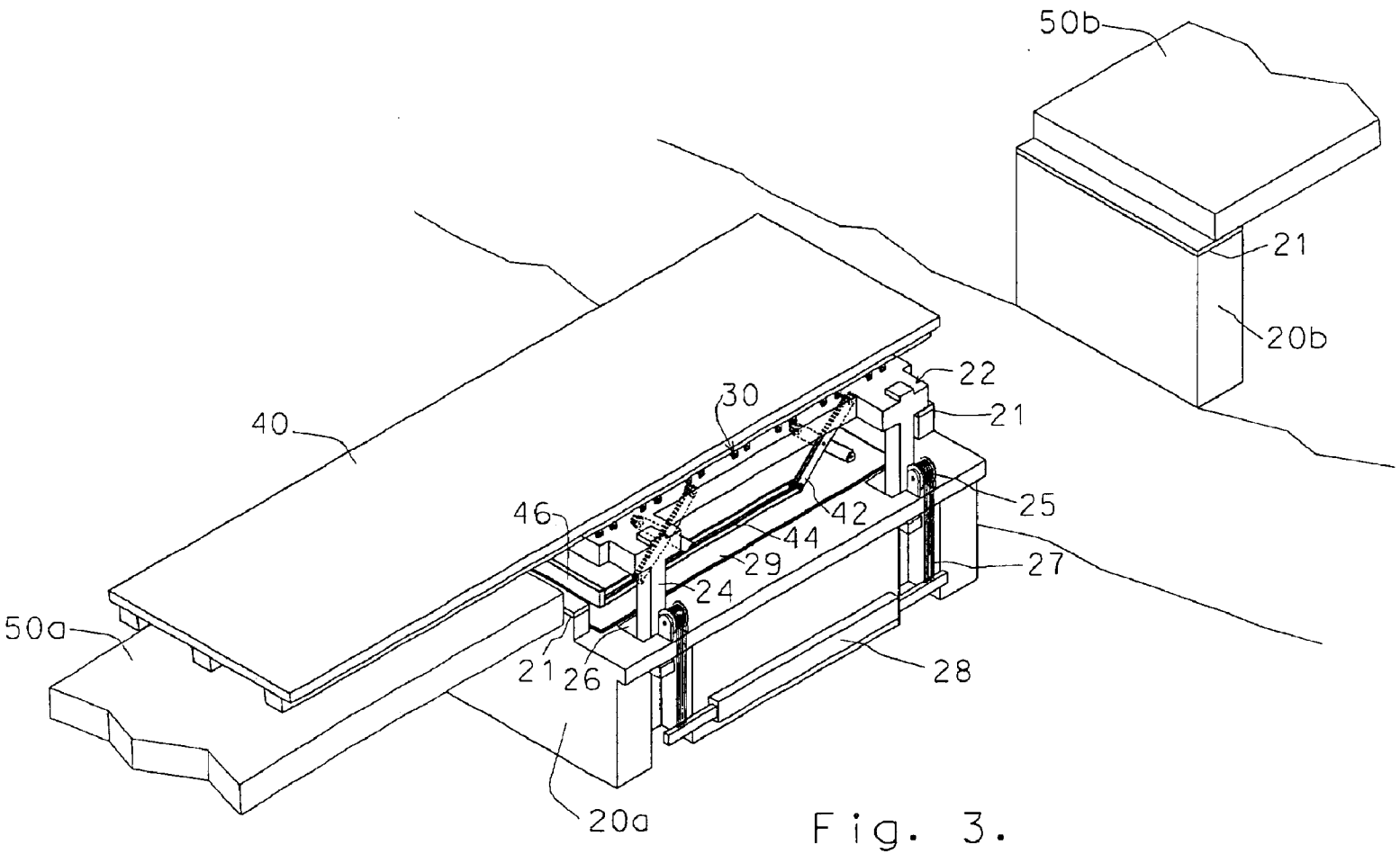
FIG. 3 illustrates a perspective view of a preferred embodiment of the invention showing the bridge in the raised-open position.
Figure 4:
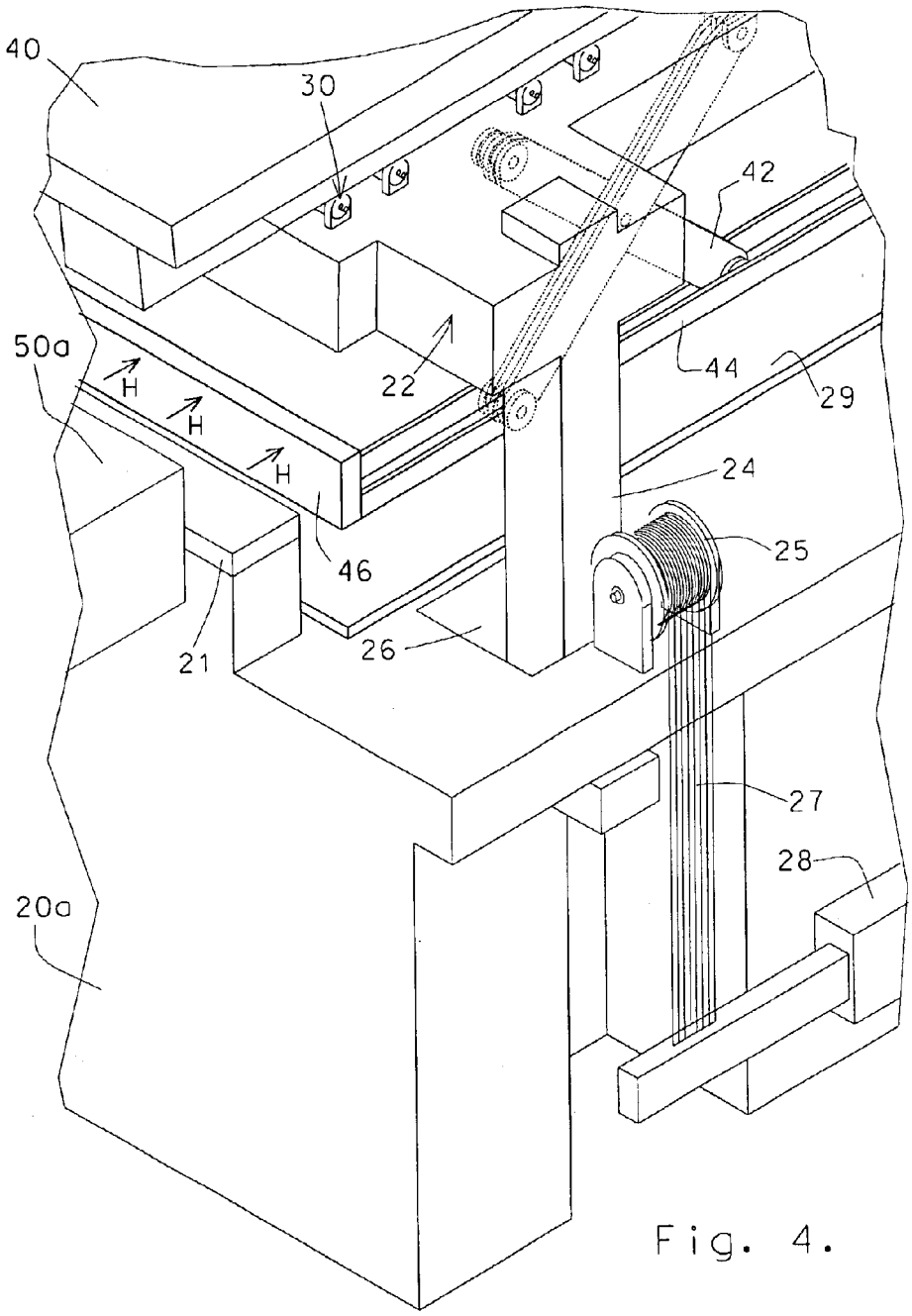
FIG. 4 illustrates an enlarged perspective view of a preferred embodiment of the invention showing the bridge lifting mechanism, sliding mechanism and the counterweight system in a raised-closed position.

The preferred embodiment of the present invention is illustrated in FIGS. 1–4 isometric views. The opening between the first approach 50*a* and the second approach 50*b* is the distance to be spanned reversibly by the drawbridge. The drawbridge of the present invention is supported by a first base 20*a* and a second base 20*b* which are positioned adjacent to the first and second approaches, respective. The first base 20*a* and a second base rise vertically from the ground to provide foundation support for the said drawbridge structure. The drawbridge structure includes a bridge deck 40, a lifting mechanism 22, lift counterweight 28 system, and a sliding mechanism 30. The sliding mechanism 30 is located at the top surface of the lift mechanism 22 being sandwiched between the lifting mechanism 22 and the bridge deck 40. The bridge deck 40 is above the sliding mechanism 30 and the lifting mechanism 22 is below said sliding mechanism 30 (FIG. 4).

Figure 5:
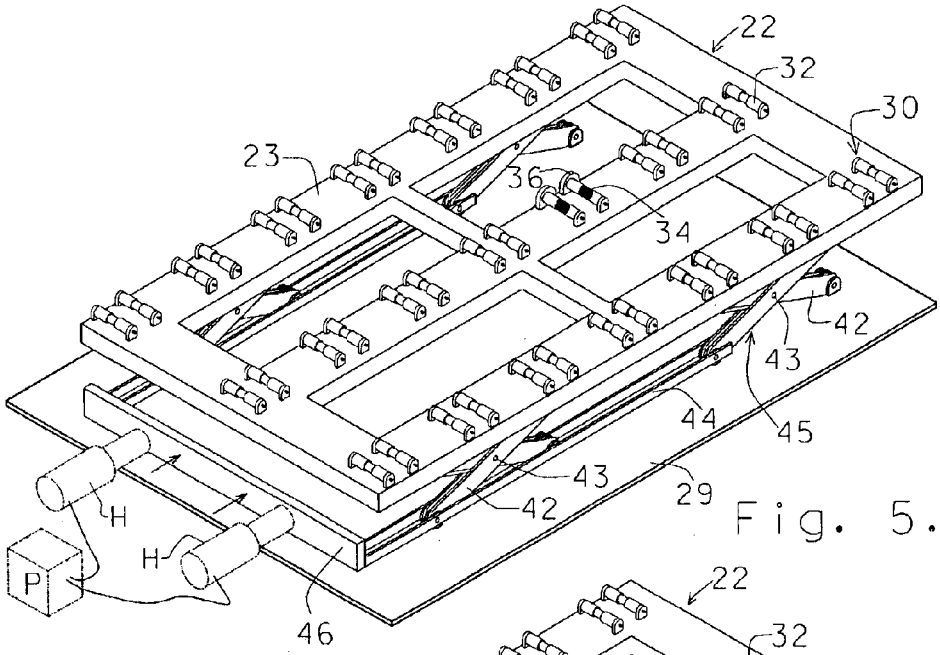
FIG. 5 illustrates a perspective view of a preferred embodiment of the invention showing the lifting mechanism in the lowered position and the sliding mechanism.
Figure 6:
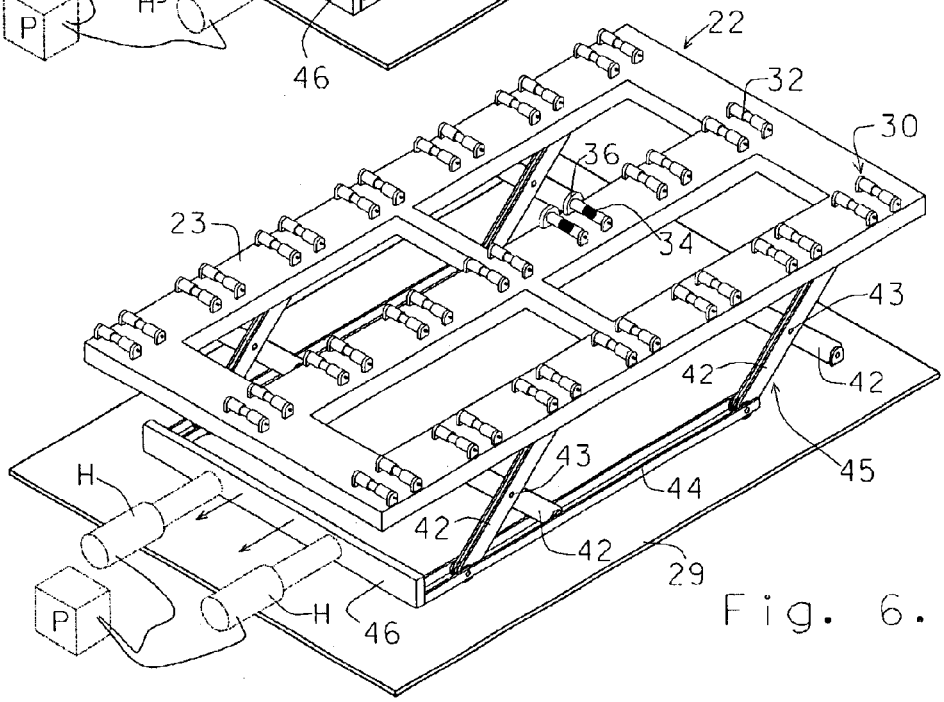
FIG. 6 illustrates a perspective view of a preferred embodiment of the invention showing the lifting mechanism in the raised position and the sliding mechanism.

The lifting mechanism 22 in FIGS. 5–6 includes a support platform 29, a lifting platform 23 which is positioned above said support platform 29, a plurality scissors apparatus 45, lifting arms 44 and a lifting beam 46. The support platform 29 secures the lifting mechanism 22 to the first base 20*a*.

The scissors apparatus 45 structure (see FIGS. 5–6) includes scissors lift arms 42 positioned between the support platform 29 and the lifting platform 23. A scissors linkage 43 couples the scissors lift arms 42 which pivot about a pivot axis. The plurality of scissor apparatus 45 are positioned at spaced locations to support a lifting platform in a horizontal orientation. The scissors linkage raise and lower said lifting platform 23 with respect to said support platform 29. The lifting bars 44 are attached to the lower end of selected scissors lift arms at points along the length of said lifting bars 44. The lifting beam 46 is connected to one end of the lifting bars. Hydraulic cylinders H are positioned along and connected to the lifting beam 46. A means of hydraulic drive system P provides force to activate the hydraulic cylinders H. The activated hydraulic cylinders H provide straight line motion to said lifting beam 46 resulting in the said scissors apparatus 45 to raise or lower the said lifting platform 23 with respect to the said support platform 29.

Figure 1:
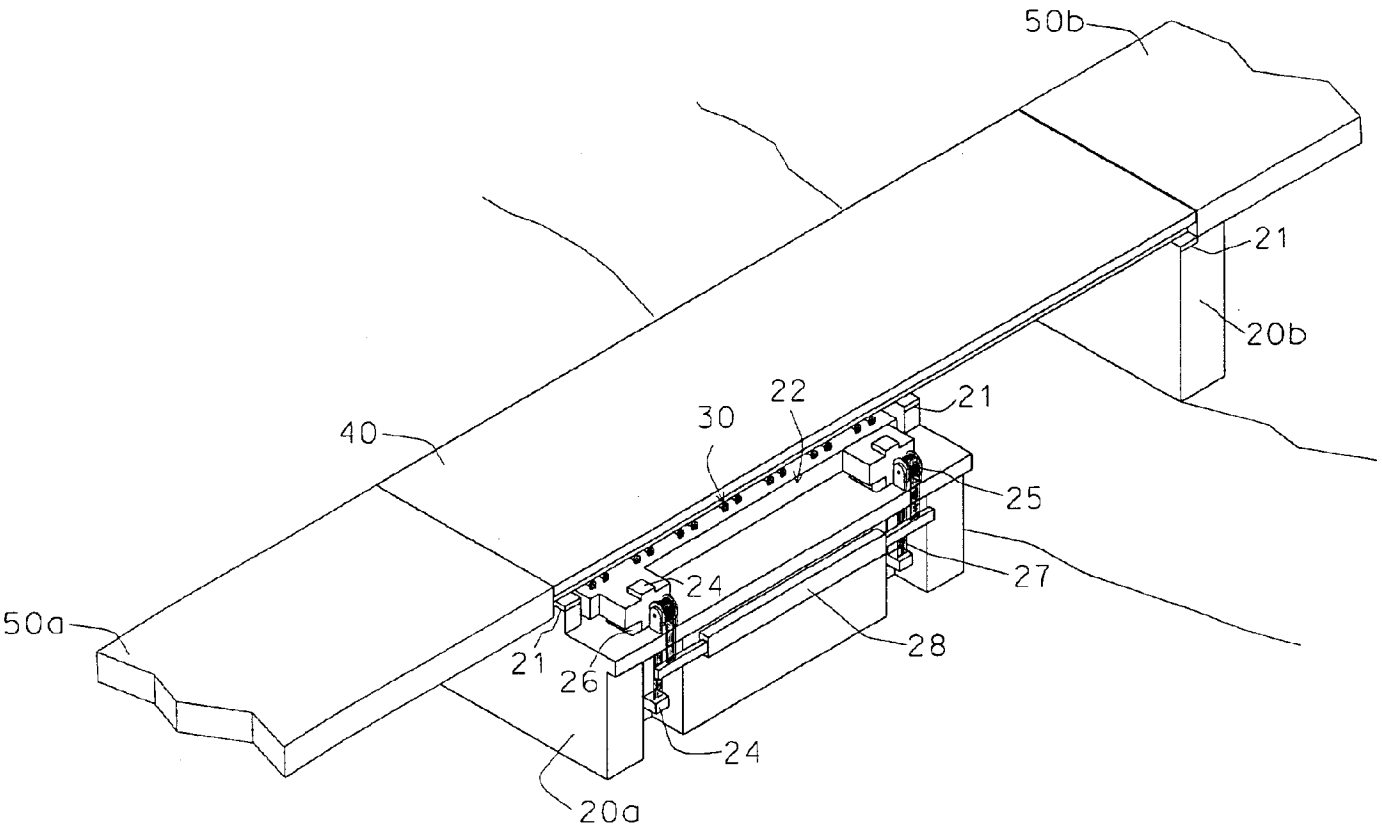
FIG. 1 illustrates a perspective view of a preferred embodiment of the invention showing the bridge in the lowered-closed position.

The lifting mechanism 22 raises and lowers the bridge deck 40 from the lowered-closed position in FIG. 1 to the raised-closed position in FIG. 2 generally in a vertical linear motion relative to the first base 20*a*. The required distance the bridge deck 40 is raised is a function of the thickness of said bridge deck 40 plus the required distance of clearance between said bridge deck 40 and the first approach 50*a*.

The bridge deck 40 generally has a rectangular shape with structural support beams on the bottom side. When in the lowered-closed position FIG. 1 the bridge deck 40 rests on base supports 21 which are located on the first base 20*a* and the second base 20*b*. In this position the bridge deck functions much like a continuous fixed span. Since while in the down position the lifting and sliding mechanisms 22, 30 are not carrying the main weight of the bridge deck 40, said lifting and sliding mechanisms 22, 30 may be inspected and repaired while the lift-slide drawbridge is in service.

When in the raised-closed position (FIGS. 2 and 6) the bridge deck is coupled to the sliding mechanism 30. The sliding mechanism 30 is connected to the surface of the lifting platform 23 which is the top platform of the lifting mechanism 22. In this position the bridge deck 40 is cantilevered toward the second base 20*b* (and second approach 50*b*) and functions like a cantilevered beam.

When in the raised-open position (FIGS. 3 and 6) the bridge deck is coupled to the sliding mechanism 30. The sliding mechanism 30 is connected to the surface of the lifting platform 23 which is the top platform of the lifting mechanism 22. In this position the bridge deck 40 is cantilevered over the first approach 50*a* and functions like a cantilevered beam.

When initially raised the lift-slide bridge deck 40 is in the raised-closed position FIG. 2. After in the raised-closed position (FIG. 2) the bridge deck 40 is positioned to slide away from said second approach 50*b* and over the first approach 50*a* to the raised-open position (FIG. 3). To close the draw the bridge deck 40 slides toward the second approach 50*b* (FIG. 2) to the raised-close position. The bridge deck 40 can then be lowered to the lowered-closed position.

Figure 7:
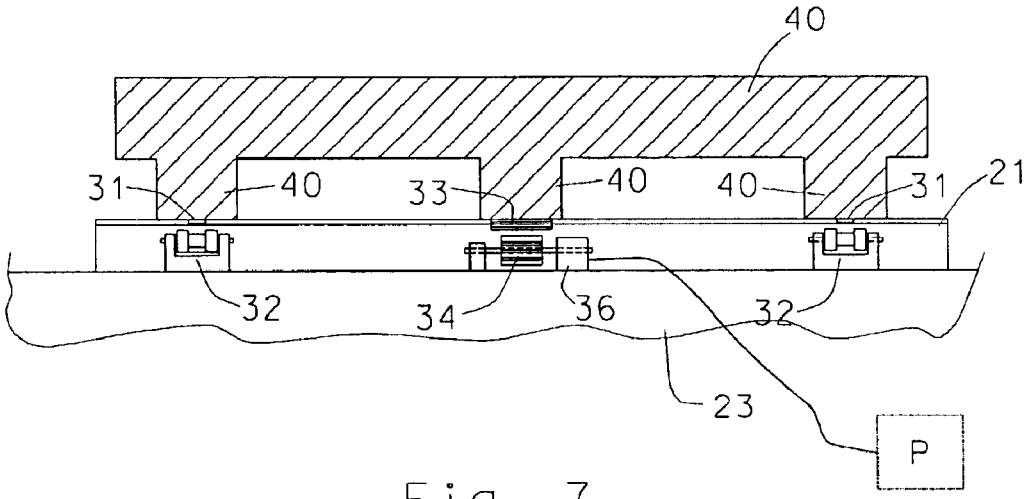
FIG. 7 illustrates an end view of the bridge deck in the lowered position with the sliding mechanism shown.
Figure 8:
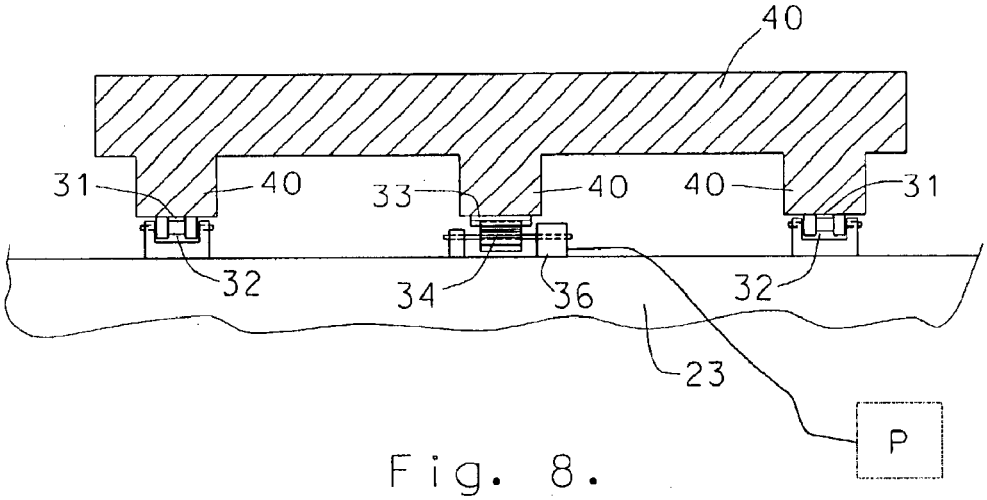
FIG. 8 illustrates an end view of the bridge deck in the raised position with the sliding mechanism shown.

The sliding mechanism 30 provides the means of sliding the bridge deck 40 horizontally as shown in FIGS. 5–8. The sliding mechanism 30 consists of deck guides 31, flanged wheel trucks 32, deck rack 33 and deck pinion gear 34 and deck drive motor 36 as shown in FIGS. 7 and 8. The bridge deck 40 is supported by and is slidably coupled to the lifting mechanism 22 by means of the sliding mechanism 30 which is sandwiched between the said bridge deck 40 and the said lifting mechanism 22 as shown in FIG. 4.

The deck rack 33 is secured to the underside of the bridge deck 40 (FIGS. 7–8). The deck drive motor 36 is secured to the surface of the lifting platform 23. The deck pinion gear 34 is coupled to the deck drive motor 36 and operatively engaged with the deck rack 33. A hydraulic drive system P provides torque to activate the deck drive motor 36 for deck pinion gear 34 to operatively engage said deck rack 33. To hold the bridge deck in position during sliding movement, deck guides 31 and flanged wheel trucks 32 are disposed between the said bridge deck and the lifting platform 23. The same hydraulic drive system P utilized to slide the bridge deck 40 is used to activate the hydraulic cylinders H for raising, lowering said bridge deck 40.

The vertical movement of the lifting mechanism 22 is facilitated by lift counterweights 28 at opposite sides of the first base 20*a* mounted on suitable pulleys 25 as shown in FIGS. 1–4. To minimize the height of the counterweight system lifting posts 24 are installed. The upper end of the lifting posts 24 are attached to the lifting mechanism 22. The lift counterweights 28 are connected to the lifting posts 24 by means of lifting cables 27 (see FIG. 1) attached to the lower end of said lifting posts 24. The lifting cables 27 thread over the pulley 25 and are then attached to the lift counterweight 28. The lifting posts 24 protrude downward through lifting post openings 26 in the first base 20*a*. The lift counterweights 28 are constructed of dense material such that their weight is sufficient to substantially offset the weight of the lifting mechanism 22, sliding mechanism 30 and the bridge deck 40. In summary, the drawbridge is opened by first vertically moving the lifting mechanism 22, upwardly to its raised-closed (apex position) where the bridge deck 40 is higher than the adjacent first approach 50*a* and clear of adjacent obstructions as shown in FIG. 2. Next the bridge deck 40 is moved away from the second approach 50*b* and over the first approach 50*a* to the raised-open position (FIG. 3.) by means of the sliding mechanism 30. In the raised-open position boats, for example, are allowed to freely pass between the first base 20*a* and the second base 20*b*. The above outlined procedure is reversed to return the drawbridge to the raised-closed position FIG. 2. then lowered to the lowered-closed position FIG. 1.

While the preferred embodiments of the invention have been illustrated and described, it will be appreciated that various changes can be made therein without departing from the spirit and scope of the invention.

Reference Numerals In Drawings

| | |
|---|---|
| 20a | first base |
| 21 | base support |
| 23 | lifting platform |
| 25 | pulley |
| 27 | lifting cable |
| 29 | support platform |
| 31 | deck guide |
| 33 | deck rack |
| 36 | deck drive motor |
| 42 | scissor lift arm |
| 44 | lifting arms |
| 46 | lifting beam |
| 50b | second approach |
| 63 | approach sidewalk |
| 65 | offset handrail |
| 68 | deck handrail |
| 74 | deck counterweight |
| 78 | interlock sleeve |
| H | hydraulic cylinder |
| 20b | second base |

-continued

| | |
|---|---|
| 22 | lifting mechanism |
| 24 | lifting post |
| 26 | lifting post opening |
| 28 | lift counterweight |
| 30 | sliding mechanism |
| 32 | flanged wheel truck |
| 34 | deck pinion gear |
| 40 | bridge deck |
| 43 | scissors linkage |
| 45 | scissors apparatus |
| 50a | first approach |
| 62 | deck support bar |
| 64 | offset sidewalk |
| 66 | deck sidewalk |
| 72 | deck support wheel |
| 76 | interlock shaft |
| P | hydraulic drive system |

FIGS. 9–16—Alternative Embodiments

Figure 9:
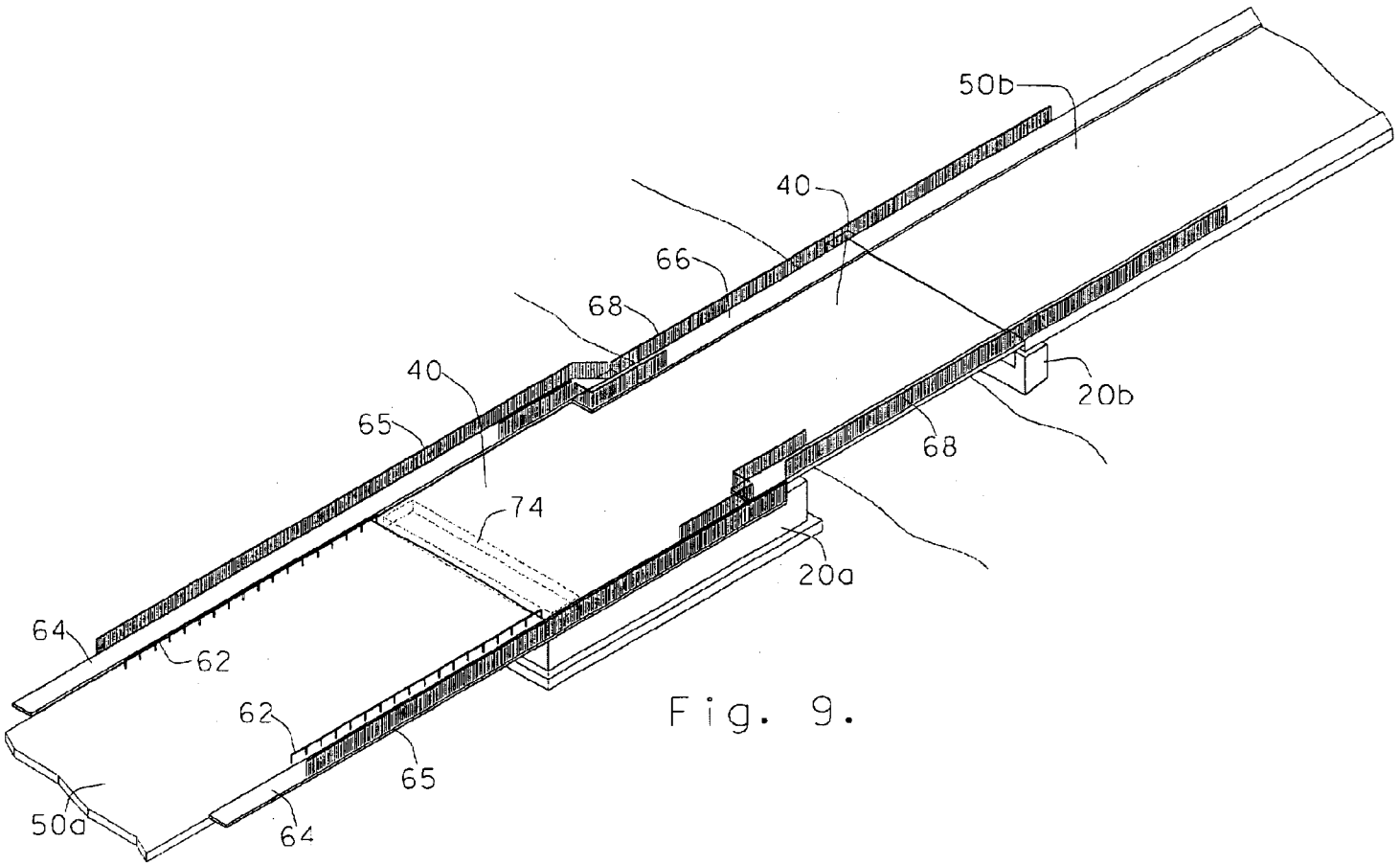
FIG. 9 illustrates a perspective view of an alternate embodiment of the invention showing the bridge in a lowered-closed position with offset sidewalks, offset handrails, deck support bar and deck counterweight.
Figure 10:
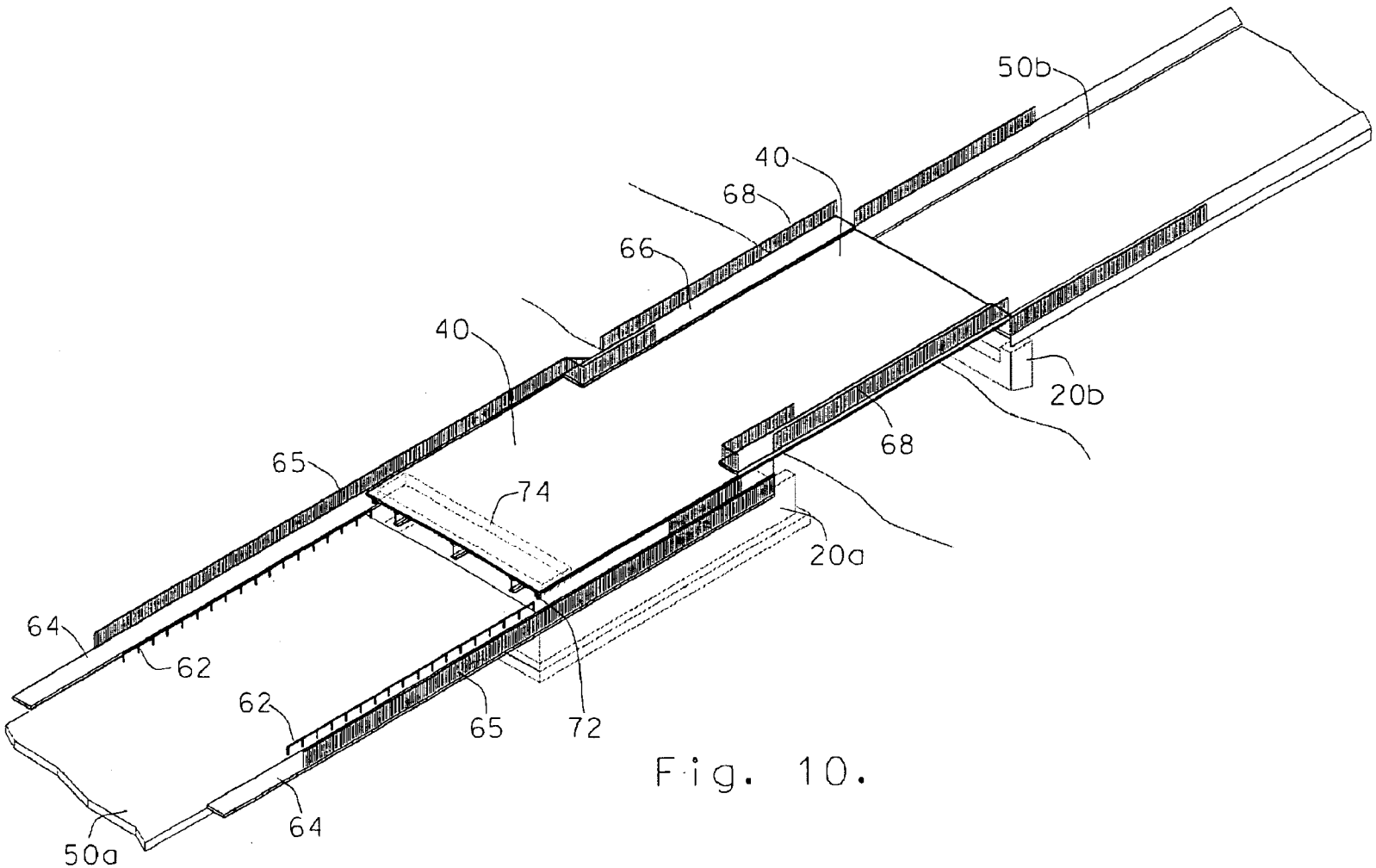
FIG. 10 illustrates a perspective view of an alternate embodiment of the invention showing the bridge in a raised-closed position with offset sidewalks, offset handrails, deck support bar and deck counterweight.
Figures 11, 12:
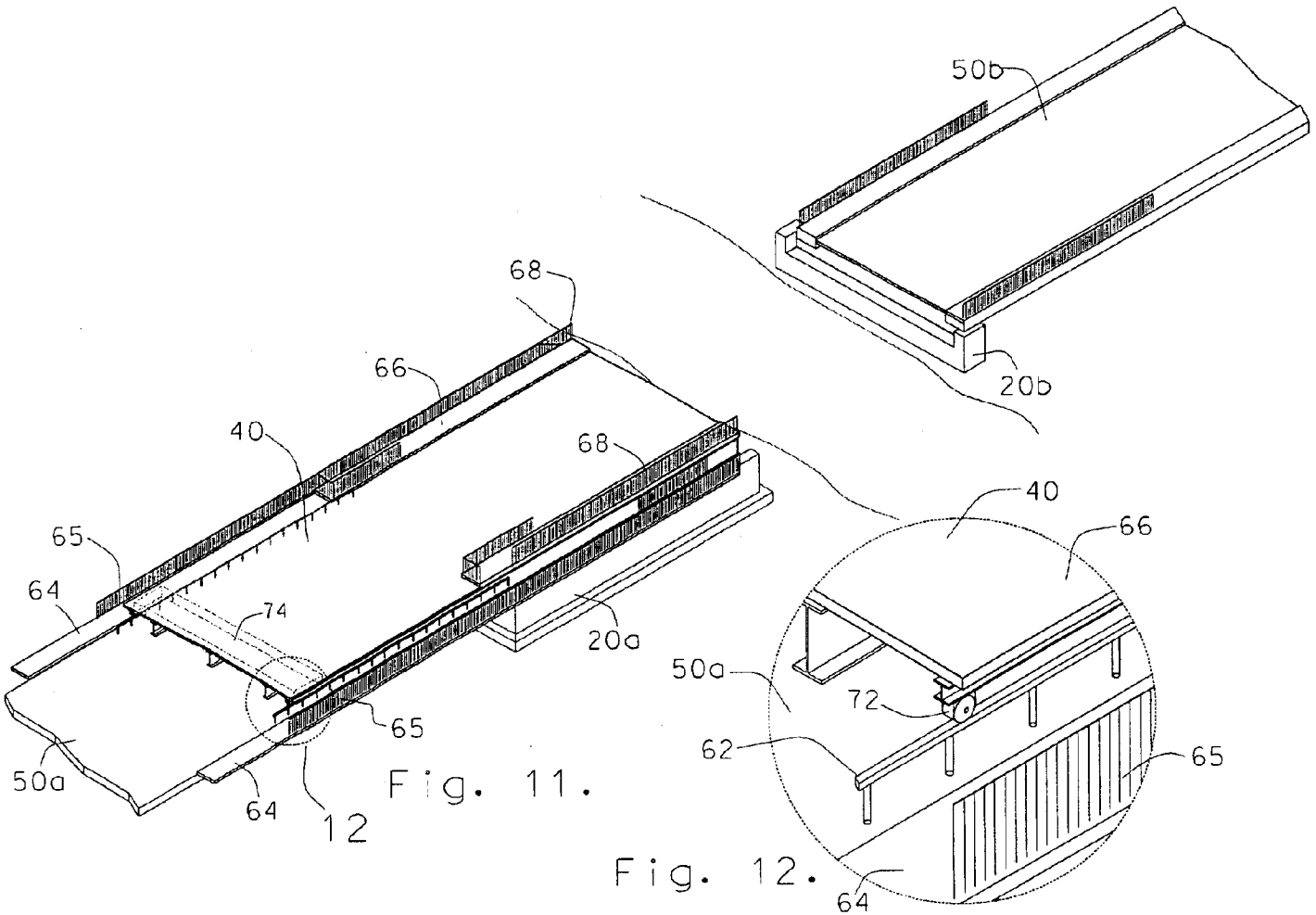
FIG. 11 illustrates a perspective view of an alternate embodiment of the invention showing the bridge in a raised-open position with offset sidewalks, offset handrails, deck support bar and deck counterweight.
FIG. 12 illustrates an enlarged perspective view of an alternate embodiment of the invention showing the deck support bar and deck support wheel.
Figure 13:
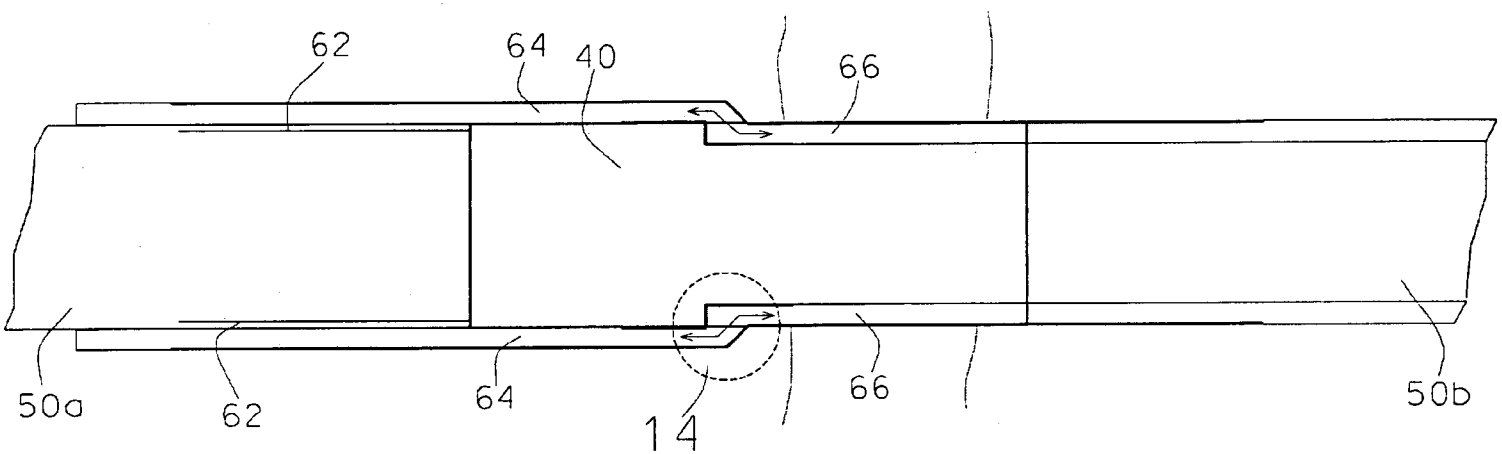
FIG. 13 illustrates a top view of an alternate embodiment of the invention showing the bridge in a lowered-closed position with offset sidewalks and offset handrails.
Figure 14:
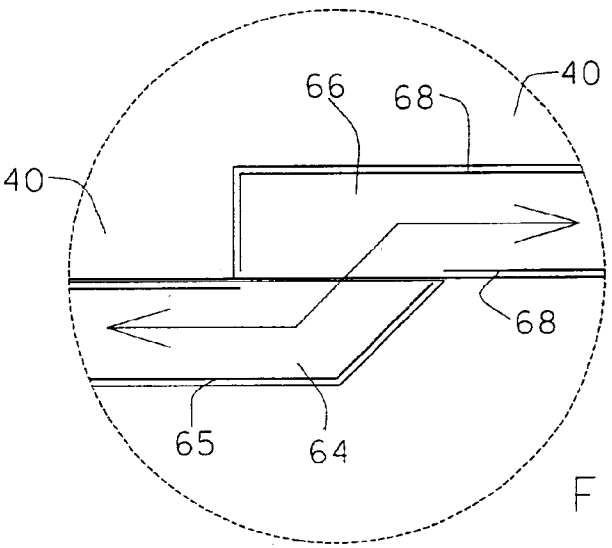
FIG. 14 illustrates an enlarged top view of an alternate embodiment of the invention showing the offset sidewalks and offset handrails.

In accordance with an alternate embodiment of this invention, a deck counterweight 74 as shown in FIGS. 9–11 is provided to assistance in the stability of the bridge deck 40 during movement. The bridge deck 40 stability is adjusted by changing the center of gravity of said bridge deck 40. The bridge deck 40 center of gravity is moved by adding a deck counterweight 74 to the bridge deck at the required location.

In accordance with another alternate embodiment of this invention, offset sidewalk 64 is provided with the said offset sidewalk 64 (see FIGS. 11–14) being offset in relation to the deck sidewalk 66 in area adjacent to the first base 20*a*. The offset sidewalk 64 allows the said offset sidewalk 64 to be placed astride and clear of the lifted sliding bridge deck 40 as shown on FIGS. 11–14. The constructed offset sidewalk 64 minimizes the overall vertical movement required by the bridge deck 40 before it is clear to slide.

In accordance with another alternate embodiment of this invention, offset handrail 65 is provided with the said offset handrail 65 (see FIGS. 11–14) being offset in relation to the deck handrail 68 in area adjacent to the first base 20*a*. The offset handrail 65 allows the said offset handrail 65 to be placed astride and clear of the lifted sliding bridge deck 40 as shown on FIGS. 11–14. The constructed offset handrail 65 minimizes the overall vertical movement required by the bridge deck 40 before it is clear to slide.

In accordance with an alternate aspect of this invention, the bridge deck 40 has a curved shape in the vertical and/or horizontal directions. Depending on the site specific conditions of a proposed lift-slide bridge location a bridge deck 40 may need to vary in shape. The vertical curve and/or the horizontal curve may be required to fit the local roadway alignment. A proposed lift-slide bridge location may require turning lanes requiring the bridge deck 40 to become asymmetrical.

In accordance with another alternate embodiment of this invention, a deck support bar 62 (see FIGS. 9–12) is provided for support of the bridge deck 40 during sliding movements. The deck support bar 62 is placed parallel to the sliding movement of the deck in the area of the first base approach 50*a*. A deck support wheel 72 is attached to the underside of the bridge deck 40 where it engages the deck support bar 62 during the sliding motion of the said bridge deck 40.

In accordance with another alternate embodiment of this invention, twin opposing lift-slide drawbridges (see FIGS. 15 and 16) are positioned on opposite sides of a draw and the extended ends of the respective bridge decks 40*a* and 40*b* are interlocked then lowered to their closed position effectively creating a twin lift-slide drawbridge. The interlock of the extended ends of the bridge decks 40 would be accomplished by means of a interlock sleeve 78 installed on the second extended end of the bridge deck 40 and a interlock shaft 76 installed on the first opposing extended end of the bridge deck 40.

The twin opposing lift-slide drawbridge would consist of basically the same design as single deck lift-slide bridge. The twin opposing lift-slide drawbridge consist of a first base 20*a*, a second base 20*b*, a first lifting mechanism 22 positioned above and configured to be supported by said first base 20*a*, a second lifting mechanism 22 positioned above and configured to be supported by said second base 20*b*, a first sliding mechanism 30 positioned above and configured to be supported by said first lifting mechanism 22, a second sliding mechanism 30 positioned above and configured to be supported by said second lifting mechanism 22. Also part of the twin opposing lift-slide drawbridge alternate embodiment is a first bridge deck 40*a* having an extended end and a base end, said base end of said first bridge deck 40*a* being slidably coupled to the first sliding mechanism 30. The sliding of the first bridge deck 40*a* projects said first bridge deck 40*a* in a direction that is toward the second base 20*b*. A second bridge deck 40*b* being positioned above and slidably coupled to said second sliding mechanism 30, wherein sliding of said second bridge deck 40*b* projects said second bridge deck 40*b* in a direction that is toward the first base 20*a*.

The first bridge deck 40*a* and the second bridge deck 40*b* are arranged and configured opposite each other on intersecting paths so that as each projects from their respective bases 20*a*, 20*b* said first bridge deck 40*a* and said second bridge deck 40*b* interconnect at their extended ends, the base ends of said bridge decks 40*a*, 40*b* being coupled to the sliding mechanisms 30. The extended end of the first bridge deck 40*a* further comprises an interlocking shaft 76, and wherein the extended end of the second bridge deck 40*b* further comprises an interlocking sleeve 78 sized to receive the interlocking shaft 76 of said first bridge deck 40*a*. The base end of the first and second bridge decks 40*a*, 40*b* further comprises an interlocking shaft 76, and wherein the first and second bases 20*a*, 20*b* further comprises an interlocking sleeve 78 sized to receive the interlocking shaft 76 of the base end of said first and second bridge decks 40*a*, 40*b*.

To operate the twin opposing lift-slide drawbridge the extended interlocked first and second bridge decks 40*a*, 40*b* are raised or lowered simultaneously by the first and second lifting mechanism 22, respective. The extended interlocked first and second bridge decks 40*a*, 40*b* also slide by the first and second sliding mechanism 30, respective.

In accordance with another alternate embodiment of this invention, a method of installing a fixed-span bridge is provided. The method may be used to install a one or two deck bridge 40*a*, 40*b*. The steps for installing a one deck bridge is to construct a first and second base 20*a*, 20*b* to support to bridge deck 40. Then construct the bridge deck 40 over the first adjacent approach 50*a* (See FIG. 3). Next slide said bridge deck 40 laterally over an obstacle to be bridged (See FIG. 2). After the bridge deck is in the correct alignment over the first and second bases 20*a*, 20*b* the bridge deck 40 is lowered to its final position on said bases 20*a*, 20*b* as shown in FIG. 1.

Figure 15:
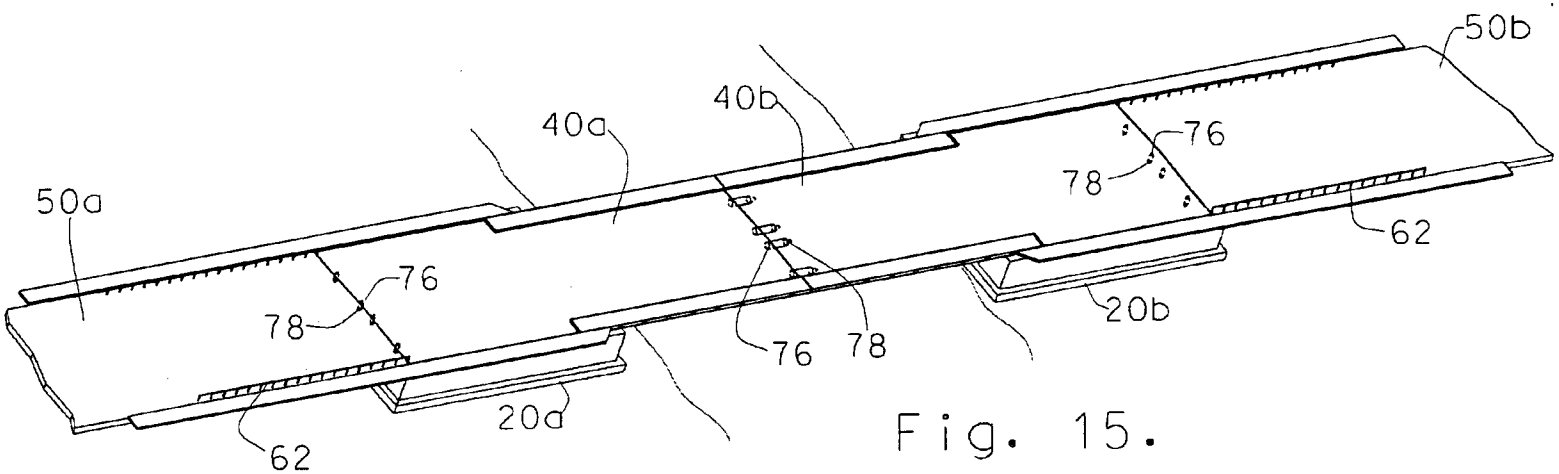
FIG. 15 illustrates a perspective view of an alternate embodiment of the invention showing twin opposing lift-slide drawbridge in a lowered-closed position.
Figure 16:
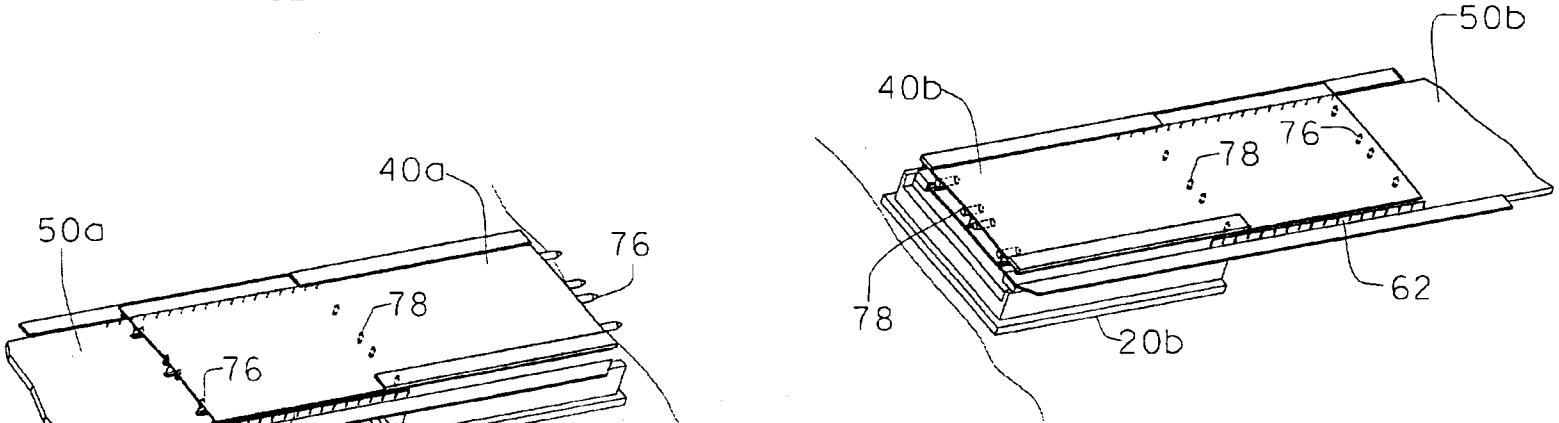
FIG. 16 illustrates a perspective view of an alternate embodiment of the invention showing twin opposing lift-slide drawbridge in an raised-open position.

The method for installing a two deck fixed-span bridge is similar to the single deck bridge except, a second bridge deck 40*b* is also constructed over the second approach 50*b* (see FIGS. 15–16). The second bridge deck 40*b* is arranged and configured opposite said first bridge deck. Next the sliding of the said first and second bridge decks 40*a*, 40*b* over an obstacle, wherein the intersecting paths of said first and second bridge decks 40*a*, 40*b* interconnect at their extended ends. The first and second bridge decks 40*a*, 40*b* are then simultaneously lowered vertically until said bridge decks 40*a*, 40*b* are supported on bases 20*a*, 20*b*. In both cases a sliding mechanism 30 and lifting mechanism 22 would be installed to facilitate the fixed-span installation. After the installation all or part of the sliding mechanism 30 and lifting mechanism 22 could then be removed from the bridge structure.

What is claimed is:

1. A drawbridge apparatus for selectively spanning an opening, such as over a river or ditch, between a first bridge approach and a second bridge approach, comprising:

a bridge deck, said bridge deck sized to span the opening between the first bridge approach and the second bridge approach;

a first base adjacent to said first bridge approach, said first base comprising a foundation structure positioned and configured to support a first end of said bridge deck such that a top surface of said first end of said bridge deck is substantially even with a top surface of the first bridge approach;

a second base adjacent to said second approach, said second base comprising a foundation structure positioned and configured to support a second end of said bridge deck such that a top surface of said second end of said bridge deck is substantially even with a top surface of the second bridge approach;

a support platform adjacent said first base;

a lifting platform below said bridge deck;

a plurality of scissor lifts positioned between said support platform and said lifting platform, each said scissor lift having a first and a second lift arm pivotally linked to one another, a lower end of said first arm pivotally attached to said support platform, a lower end of said second pivot arm pivotally linked to a scissors lift bar;

a lifting beam attached to an end of said scissors lift bar;

a drive means for providing straight line motion to said lifting beam for selectively raising or lowering said scissors lifts to thereby raise or lower said lifting platform with respect to the said support platform;

a deck rack secured to the bridge deck;

a deck drive motor secured to the lifting means;

a deck pinion gear coupled to said deck drive motor and to said deck rack;

a plurality of wheel trucks disposed on the top surface of said lifting means, the bridge deck slidably coupled on top of said lifting means via said wheel trucks; and a drive means to provide torque for said deck pinion gear to operatively engage said deck rack.

2. The apparatus of claim 1 further comprising a plurality of wheel trucks disposed on the top surface of the lifting means, the bridge deck slidably coupled on top of said lifting means via said wheel trucks.

3. The apparatus of claim 2, wherein the wheel trucks are flanged.

4. The apparatus of claim 1, further comprising a counterweight means connected to the lifting means to facilitate the raising or lowering of said lifting means with respect to the first base.

5. The apparatus of claim 4, wherein the counterweight means comprises:

a lifting post attached to the lifting means at said lifting post upper end;

a lifting post opening in the first base with said lifting post extended downward through said lifting post opening;

a cable is extended downward through said lifting post opening and connected to the lower end of the said lifting post;

a pulley supported by said first base with said cable threaded over said pulley; and a counterweight with the other end of said cable connected to said counterweight.

6. The apparatus of claim 1, wherein a means of deck support is provided to maintain the horizontal orientation of the bridge deck at all sliding positions.

7. The apparatus of claim 1, further comprising a sidewalk supported by the bridge deck, said sidewalk offset astride said bridge deck in the area adjacent to the first base.

8. The apparatus of claim 1, further comprising a handrail supported by the bridge deck, said handrail offset astride said bridge deck in the area adjacent to the first base.

9. A drawbridge apparatus for selectively spanning an opening, such as a river or ditch, between a first bridge approach and a second bridge approach, comprising:

a first base adjacent to said first bridge approach;

a second base adjacent to said second bridge approach;

first and second bridge decks are arranged and configured to project from the first and second bridge approaches, respectively, to a location between said two bridge approaches at which location said bridge decks interconnect;

first and second lifting means positioned above and configured to be supported by said first and second bases, respective; wherein said lifting means is positioned to selectively raise said first and second bridge decks until said bridge decks are above said first and second bridge approaches;

first and second sliding means below said first and second bridge decks and above said first and second lifting means, respectively, wherein said first and second bridge decks are slidably coupled to the said first and second lifting means; and a drive means for raising, lowering or sliding said first and second bridge decks.

10. A method of installing two fixed span bridge decks, comprising the steps of:

constructing bases;

constructing a first bridge deck over a first adjacent approach;

constructing a second bridge deck over a second adjacent approach; wherein said second bridge deck is arranged and configured opposite said first bridge deck;

sliding said first and second bridge decks over a obstacle, wherein the intersecting paths of said first and second bridge deck interconnect at their extended ends;

simultaneously lowering said first and second bridge decks vertically until said first and second bridge decks are supported on bases; and locking base ends of said first and second bridge decks to prevent vertical movement.

11. A drawbridge apparatus comprising:

a first base;

a second base;

a first lifting means positioned above and configured to be supported by said first base:

a first sliding means positioned above and configured to be supported by said first lifting means;

a first bridge deck having an extended end and a base end, said first bridge deck being slidably coupled to said first sliding means, wherein sliding of said first bridge deck projects said first bridge deck in a direction that is toward or away from the second base;

a second lifting means positioned above and configured to be supported by said second base;

a second sliding means positioned above and configured to be supported by said second lifting means; and a second bridge deck having an extended end and a base end, said second bridge deck being positioned above and slidably coupled to said second sliding means, wherein sliding of said second bridge deck projects said second bridge deck in a direction that is toward or away from the first base.

12. The apparatus of claim 11, wherein the first bridge deck and the second bridge deck are arranged and configured opposite each other on intersecting paths so that as each projects from the bases said first bridge deck and said second bridge deck interconnect at their extended ends, the base ends of said bridge decks being coupled to the means of sliding.

13. The apparatus of claim 12, wherein the extended end of the first bridge deck further comprises an interlocking shaft, and wherein the extended end of the second bridge deck further comprises an interlocking sleeve sized to receive the interlocking shaft of said first bridge deck.

14. The apparatus of claim 13, wherein the extended interlocked first and second bridge decks are raised or lowered simultaneously by the first and second means of lifting.

15. The apparatus of claim 12, wherein the base end of the first and second bridge decks further comprises an interlocking shaft, and wherein the first and second bases further comprises an interlocking sleeve sized to receive the interlocking shaft of the base end of said first and second bridge decks.

16. A drawbridge apparatus for selectively spanning an opening, such as a river or ditch, between a first bridge approach and a second bridge approach, comprising:

a bridge deck;

a means of supporting said bridge deck over said opening;

a means of lifting said bridge deck above said first approach until the bottom of said bridge deck is above the top said first approach; and a means of sliding said bridge deck over said first bridge approach;

whereby, said means of supporting, said bridge deck maintains the top surface of said bridge deck adjacent to and substantially even with said top surface of said first and second bridge approaches;

whereby, in the lifted position, sliding of said bridge deck over said first bridge approach is unobstructed; and whereby, after sliding, said opening between said first and second bridge approaches is provided.

17. A method of providing a reversible draw for a drawbridge apparatus, comprising the steps of:

lifting a bridge deck from the position in which the top of said bridge deck is substantially even with the top of an adjacent approach until the bottom of said bridge deck is above the top of said adjacent approach; and sliding said bridge deck laterally over said adjacent approach until said reversible draw is provided;

whereby, after lifting, the sliding of said bridge deck over said adjacent approach is unobstructed.

18. A method of installing a bridge deck over an obstacle, comprising the steps of:

constructing a first and a second base;

constructing said bridge deck over said first base and a first approach;

sliding said bridge deck laterally over said obstacle toward a second base; and lowering said bridge deck until said bridge deck is supported on said first and second bases;

whereby said first and a second bases are configured to allow the top of lowered said bridge deck to be substantially even with the top of adjacent said first and second approaches;

whereby said sliding said bridge deck places the extended end of said bridge deck over said second base;

whereby after sliding said bridge deck is unobstructed for lowering; and whereby, lowering said bridge deck, places the top of said bridge deck adjacent to and substantially even with the top of said first and second approaches.

* * * * *